US005313908A

United States Patent [19]

Kunz

[11] Patent Number: 5,313,908

[45] Date of Patent: May 24, 1994

[54] CAR TOPABLE CATAMARAN WITH COLLAPSIBLE FRAME AND UNIVERSAL TILLER/RUDDER-MAST DAGGERBOARD MOUNTING CONSTRUCTIONS

[76] Inventor: Daniel W. Kunz, 5903 Mount Eagle Dr. #1002, Alexandria, Va. 22303

[21] Appl. No.: 593,432

[22] Filed: Oct. 5, 1990

[51] Int. Cl.[5] ..... B63B 7/00

[52] U.S. Cl. ..... 114/354; 114/61

[58] Field of Search ..... 114/352-354, 114/345, 39.1, 162, 163, 165, 61

[56] References Cited

U.S. PATENT DOCUMENTS 4,998,498 3/1991 Gallichan ..... 114/354

*Primary Examiner*—Ed Swinehart

*Attorney, Agent, or Firm*—Jim Zegeer

[57] ABSTRACT

A catamaran has a collapsible frame and a pair of elongated pontoons spacedly secured in collapsible frame. The frame includes fore and aft cross bar sub-frame members and a pair of longitudinally extending sub-frame members and a support platform supported on the frame. Each said longitudinally extending sub-frame member being molded and including a pontoon embracing longitudinal cavity which is the length of the longitudinally extending sub-frame member, and a pair of parallel longitudinal edges, one longitudinal edge at each side of the longitudinal cavity, respectively. A first of the longitudinal edges has a slot therein and the other of the longitudinal edges has a shape complementary to the longitudinal slot whereby pairs of longitudinal edges of the pair of molded sub-frame members, respectively, can interfit such that the concavities face each other to form a storage space for the pontoons and the fore and aft tubular sub-frame member when not in use. The pontoon embracing cavity may include an arcuate concave wall extending between said pair of longitudinal edges. A centerboard and/or rudder mounting member is provided.

34 Claims, 9 Drawing Sheets

CAR TOPABLE CATAMARAN WITH COLLAPSIBLE FRAME AND UNIVERSAL TILLER/RUDDER-MAST DAGGERBOARD MOUNTING CONSTRUCTIONS

BACKGROUND AND BRIEF DESCRIPTION OF THE INVENTION

In my U.S. Pat. No. 4,766,830 and in my International Application No. PCT/US87/01972, I disclose a car-topable catamaran having inflatable pontoons and a rectangular collapsible frame in which the frame sub-assemblies could be collapsed so as to easily be car-topable and serve as a rack for containing other components of the catamaran. Inflatable hulls were secured in the bracket arches on the undersides of the sub-frame assemblies and a rudder frame or cage was pivotally mounted on the aft sub-frame assembly and adapted to receive a rudder which was identical to and interchangeable with the daggerboards.

The present invention is directed to improvements in catamaran-type boats, particularly sail boats, of the type disclosed in my above-identified U.S. patent and PCT application. Specifically, the invention herein is directed to improvements resulting in simplicity and ease of assembly, comfort, transport, ease of sailing for novices, as well as skilled sailors, manufacturing economies, and use of interchangeable components, and parts. Further, the sailboat according to the present invention provides safety, simplicity, comfort, ease of use at a reasonable cost. Fabrication techniques used in the manufacture of high performance boats have been incorporated in the present invention. The pontoons are made of "white water" quality material that is puncture-and-abrasion resistant. Each pontoon has two or more chambers and the mast tripod system (shrouds) is made of aluminum or composite tubing or aluminum magnesium alloy and reduces the novice's fears of ropes, wires and other items such as shackles, couplings, etc. Each pontoon cover (deck plate) may be foam-filled, and made of multiple layer fiberglass. The fore and aft cross tubes, mast and shroud tubes are foam-filled. Thus, even in the extremely unlikely event that all four pontoon chambers are punctured simultaneously, the foam-filled pontoon covers and inflatable boltsters or rollers will keep a sailor afloat until assistance arrives. By design, the boat herein sails nearly flat in all but the most severe weather conditions. This absence of heeling encourages relaxation that does not require the participants to shift from one side of the boat to the other when changing sailing directions. Because of its simplicity of design, it is easy for the non-sailor to master quickly.

In a preferred embodiment, a 16 foot boat incorporating the invention weighs about 200 pounds which is 35 to 50 percent less than similar sized boats. Furthermore, in a preferred embodiment, no individual component weighs more than about 35 pounds making the boat easy to handle by nearly anyone.

As noted above, many parts are made interchangeable. For example, the mast front centerboard mounting is a single aluminum magnesium casting which is used for both stepping the mast and mounting the centerboard or daggerboard, and the tiller/rudder assembly. A mast clevis at the lower end of the mast and the clevises for rigid shroud tubes, tiller arm and the like are interchangeable. The center or daggerboard and the rudder plate are interchangeable. The rigid shroud tubes are mounted on the molded deck plate assembly by a rotatable bar.

The hulls are interchangeable as well as the two deck plate assemblies. These two deck plate assemblies may be molded plastic with foam-filling which have pontoon embracing concavities which have edges shaped such that when the two deck plates are assembled they stack or interfit like a clam shell so that all tubes, sails, centerboard, rudder, deflated pontoons and components can nest into them. Moreover, this makes a strong container for storage and for car toping by even the smallest of cars. The entire boat when packed for storage or transport, in one preferred embodiment disclosed herein, measures only about 23 inches high by about 20 inches wide and about 8 feet long.

BRIEF DESCRIPTION OF THE DRAWINGS

The above and other advantages, features of the invention will become more apparent when considered with the following specification and accompanying drawings wherein.

DETAILED DESCRIPTION OF THE INVENTION

Figure 1:
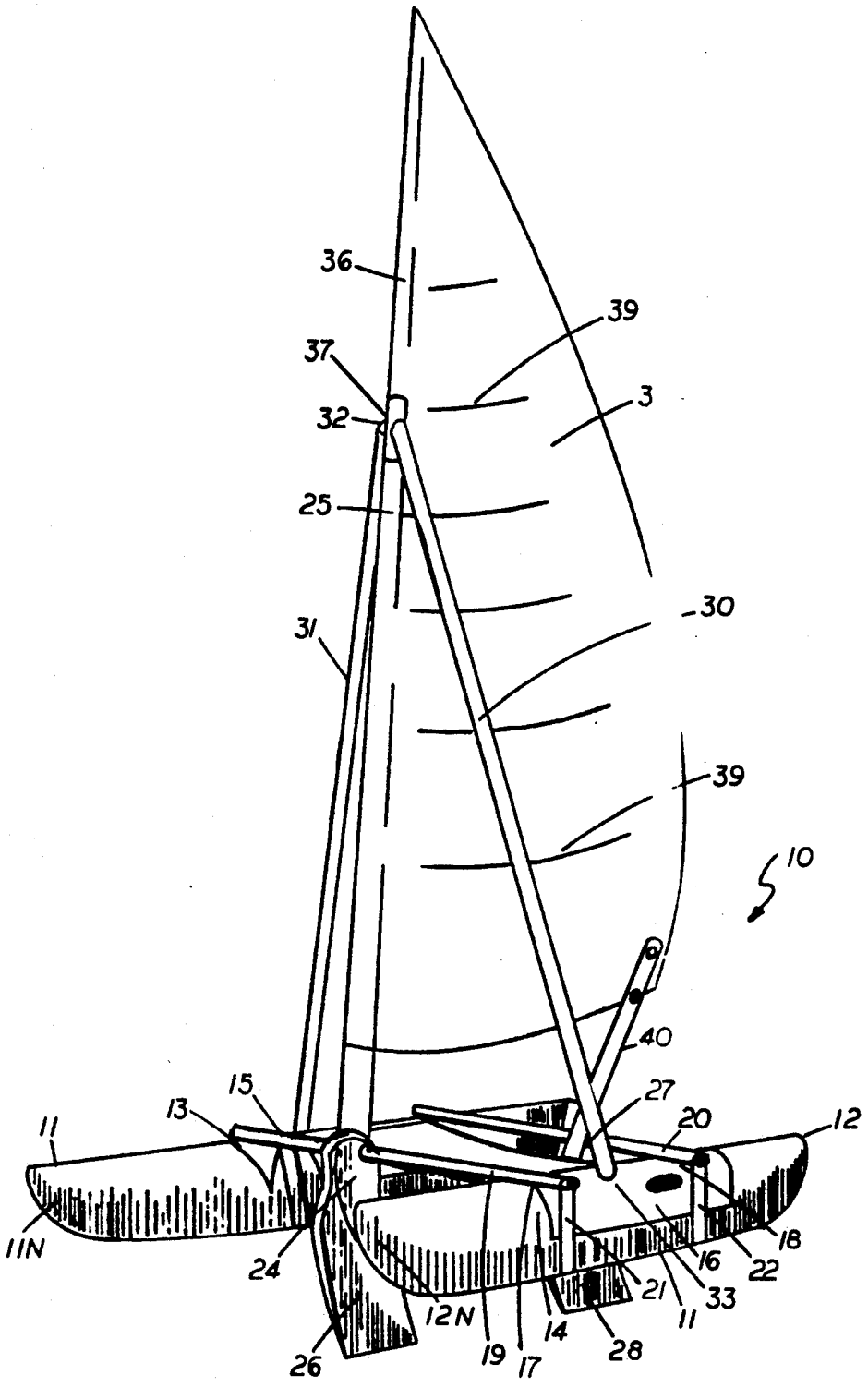
FIG. 1 is a perspective view of an inflatable catamaran incorporating the invention.

Referring to FIG. 1, an inflatable catamaran 10 includes a pair of elongated pontoons or hulls 11 and 12 which are identical and interchangeable and have tapered ends 11N and 12N. In the preferred embodiment, both ends of a hull are the same. These hulls typically have multiple chambers $C_1$, $C_2$ (see FIG. 8*b*) with separate fill valves (not shown) so that any one air chamber would be sufficient to maintain the entire boat afloat. These hulls 11 and 12 are each embraced by a pontoon embracing longitudinal cavity 13 and 14, respectively, which are formed in longitudinally extending molded sub-frame members 15 and 16, respectively. Molded sub-frame assembly members 15 and 16 have fore and aft molded saddles or sockets 17 and 18 (since the molded sub-frame members 15 and 16 are identical, only one will be described in detail) for receiving the lateral ends of fore and aft cross-bar sub-frame members 19 and 20, respectively.

Sockets 17 and 18 and the lateral ends of fore and aft cross-bars 19 and 20 have interfitting guide and locating pins 17P which are described more fully hereinafter. The lateral ends of fore and aft cross-bar sub-frame members 19 and 20 are maintained in sockets 17 and 18 by stretchable retaining straps 21 and 22, respectively, which are secured or hooked on the outer end of cross-bars 17 and 18, respectively, encircle the pontoon 12 (the similar arrangement being on the opposite side in connection with pontoon 11) and hook on the opposite side on an inwardly spaced end of cross-bars 19 and 20, respectively. Outer hook 21OH is received in an aperture 21A in cross-bar 19 or looped over locating pin 17P and inner hook 21IH is wrapped around the bar 19 and into a brass eyelet or grommet 21G in strap 21. See FIG. 8*b*. In an alternative preferred embodiment, large rubberbands may be used. In this way, because of the stretchability of the retainer straps, which are preferably flat bungie-type cords (also called shock cords), any loss of air in any of the pontoon chambers is accommodated so as to maintain the assembly in snug relation. Alternatively, a large rubber band can be looped over the cross-bar sub-frames and around the pontoon and hooked on the outer end or on pin 17P. Also, when two deck plates are clam-shelled together, the bungi cords can be used to hold the parts together as a box.

Figure 9B:
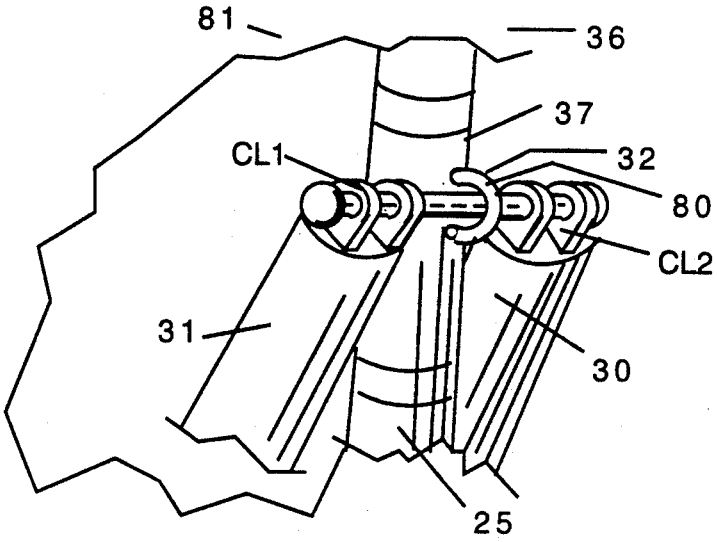
FIG. 9*b* is a perspective elevational view of the coupling of the shrouds to the mast assembly.

The fore cross-bar 19 has mounted thereon an integrally cast bracket 24 (FIG. 11*a*) for stepping the mast 25 and a center board 26 as will be described more fully hereafter. The aft cross-bar sub-frame member 20 uses the same casting 27 which mounts a rudder 28 and a tiller handle 29 (see FIG. 11*c*). The mast 25 is pivotally mounted on bracket 24 as will be described more fully hereinafter and is maintained in an upright sailing position by a pair of rigid shroud tubes 30 and 31 which are pivoted at their upper ends to a mounting loop 32 (see FIG. 9*b*) and at their lower ends to a mounting fixture 33 which is secured in each of the molded longitudinally sub-frame members 15 and 16, respectively (see FIGS. 7*a* and 7*b*). The sail 35 has a sock or sleeve 36 which telescopes over mast 25 and a cut-out 37 is provided for the shroud mounting loop coupling assembly. Instead of a loop 32, a hole may be provided in the mast section and pin or bar 81 (described later herein) passes through the hole in the mast.

Sail 35 is provided with battens 39 and controlled by a main sheet 40 connected between the trailing corner of the boomless sail 35 and aft rudder casting. It will be appreciated that the sail may include a boom, if desired and the mast may be provided with a conventional guide and trackway for a sail with a pulley to raise and lower the sail in the conventional fashion. However, the disclosed embodiment is preferred since this will provide greater ease of use for novice sailors.

Figure 2:
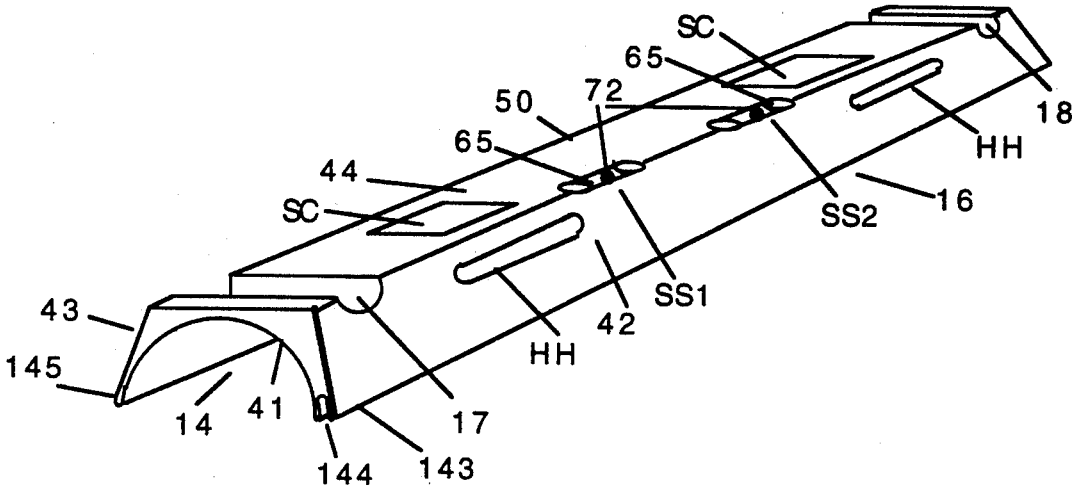
FIG. 2 is a perspective view of a molded frame sub-assembly incorporating the invention.
Figure 3:
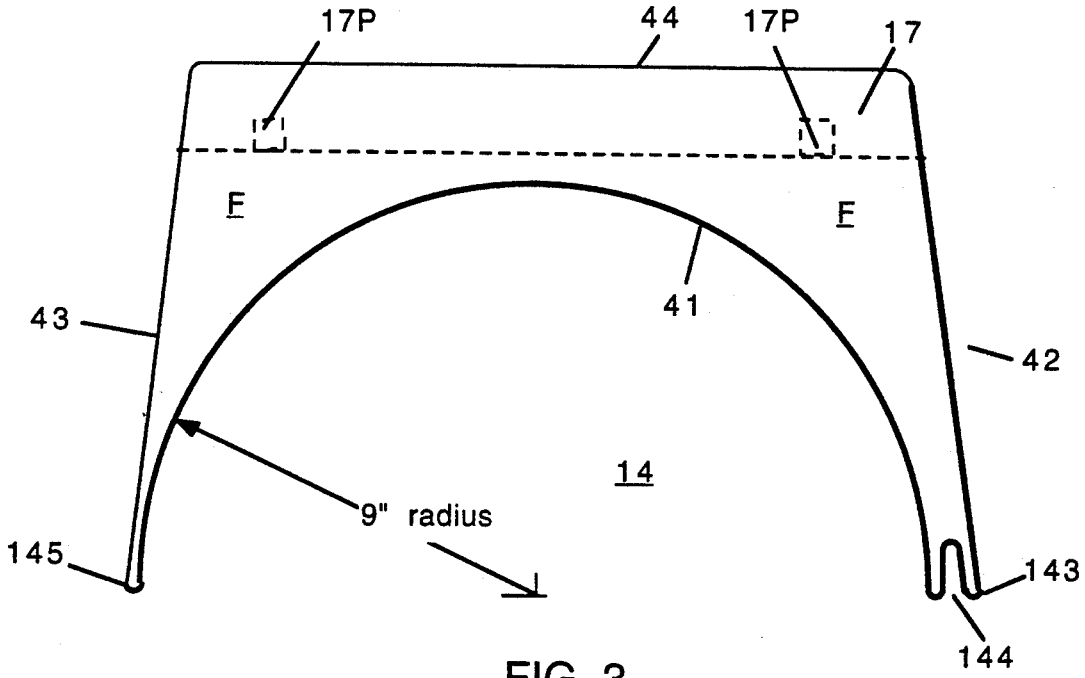
FIG. 3 is an end view of the molded deck framing assembly shown in FIG. 2, FIG. 4*a* and 4*b* are enlarged sectional views showing the edges of the pontoon embracing longitudinal cavity.
Figure 4A:
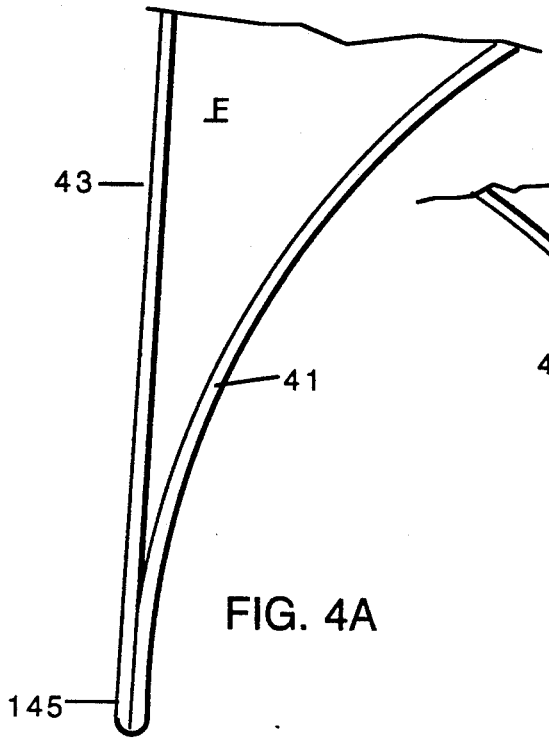
FIG. 4*c* shows the interfitting engagement of the longitudinal edges of the concave pontoon embracing cavities.
FIG. 4*d* is an isometric perspective view showing the interfitting or clam shell engagement for storage and car-topping purposes of the molded sub-frame members for receiving and storing the pontoons and other component parts of the boat.
FIG. 4*e* illustrates a modification wherein the hull embracing cavity is constituted by the sidewalls 42, 43 and top wall 44.

The molded longitudinally extending sub-frame members are illustrated in FIGS. 2, 3, 4*a*, *b*, *c* and *d*, 5 and 8*b*. As shown in FIG. 2, each longitudinally extending sub-frame member is molded of multi-laminate fiberglass, the external surfaces being provided with the conventional gel coats and the like for aesthetic purposes and ease of handling. As shown, molded sub-frame member 16 may be provided with a pontoon embracing longitudinal cavity 14 defined by concave wall 41 and three generally planar exterior sidewalls 42, 43 and top wall 44, the upper surface of top wall 44 has formed therein a pair of spaced saddles or sockets 17 and 18 for receiving the lateral ends of fore and aft cross-bars 19 and 20, respectively. (All dimensions are exemplary). Molded member 16 is hollow and preferably sealed and preferably filled with closed cell foam so that in conjunction with the multi-cells of the inflatable pontoons 11 and 12, the molded members provide additional flotation for safety purposes. The foam also is a good insulator and allows the insertion of bins in which soft drinks (FIG. 2, items SC) or valuables can be stored. In one design, these members, foam cores are about 4 inches in diameter, about 8 feet long and together provide sufficient flotation such that if both pontoons loose all buoyancy, there is still sufficient flotation to provide safety for the user. Members may be lined with foam or foam cores (tubular could be used). It will be appreciated that the sidewalls 42, 43 and top wall 44 may be molded separately from concave wall 41 and these units then bonded together and, as shown later, a concave wall 41 is not used in some embodiments.

Figure 4B:
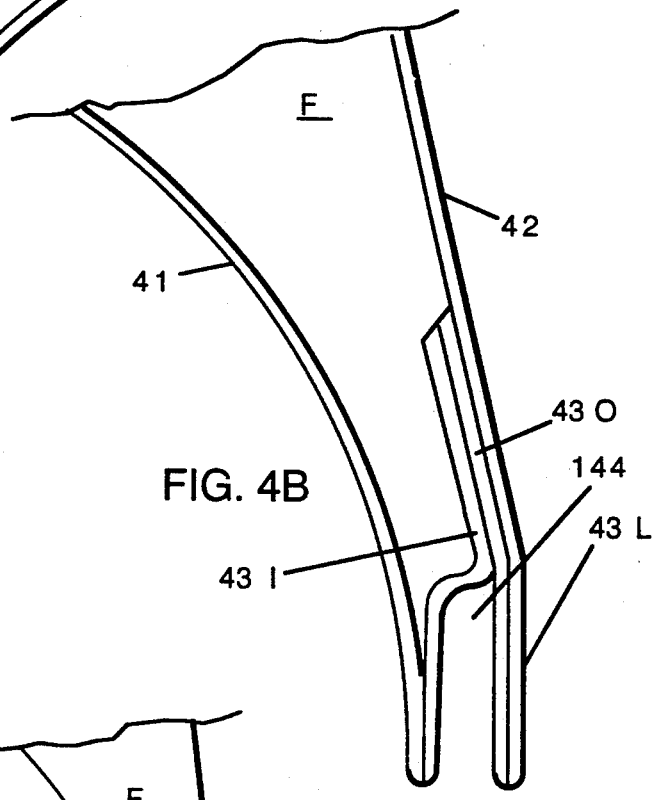

In a preferred design, inner concave wall 41 has lateral edges which taper to longitudinal edges at each side of the longitudinal cavity 14. A first longitudinal edge 143 has a slot 144 therein and the other edge 45 has a shape complementary to the slot so that the pairs of longitudinal edges of a pair of the molded sub-frame members can interfit with the concavities 14 facing each other to form a storage space for the pontoons (when deflated) and the fore and aft tubular frame members centerboard, rudder, mast and shrouds (which are collapsible), as well as all other components of the boat. The dimensions shown in FIGS. 4*a* and 4*b* are exemplary. The spaces defined by concavity wall 41 and outer walls 42, 43, 44 are poured or filled with foam having, for example, a plus 2 pound density. In forming the groove 144 as illustrated, the tape is formed with 10 ounce fiberglass tape, 2 inches wide, 2 layers thick. Thus, element 43I and element 430 are composed of two layers of 10 ounce fiberglass tape 2 inches wide which runs along the length of the edge 143 of the molded member 16 to form the groove 144 when the fiberglass resins have been cured on a mold form.

As shown in FIG. 3, the sockets or saddles 17 are provided with upwardly projecting pins 17P which fit into apertures or holes in the lateral ends of the fore and aft cross-bars to guide and position and maintain the location of the cross-bars in these sockets or saddles. It will be appreciated that the pins 17 can be provided on the cross-bars and complementary apertures formed in the lower wall of the sockets or saddles 17 and 18, respectively.

Figure 4C:
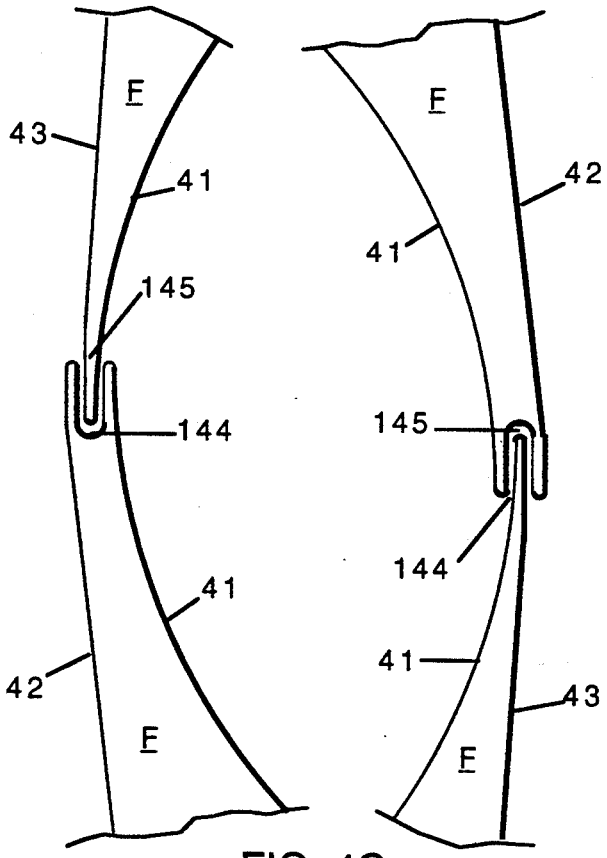
Figure 4D:
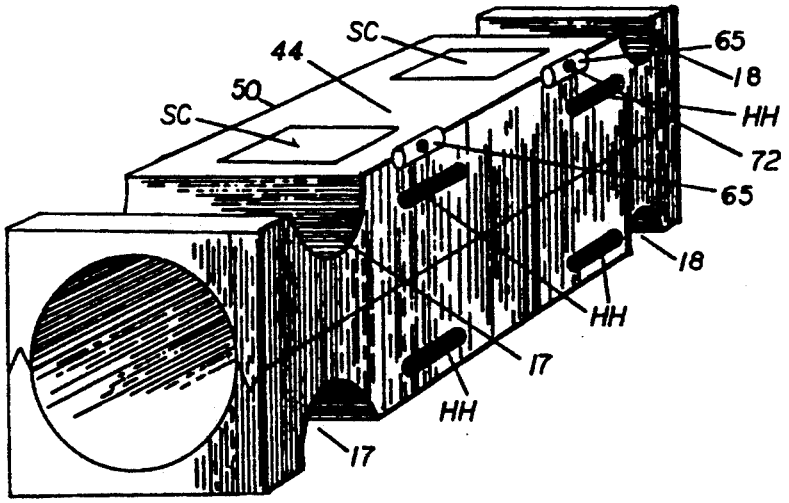
Figure 4E:
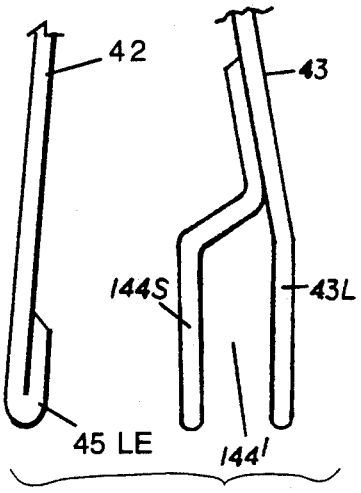

FIG. 4c illustrates the interfitting relationship of the lateral edges. In this illustration, the top portions of the molded sub-frame members are not shown, but they are shown in assembled relation in FIG. 4d. As shown in FIG. 4e, instead of a circular concavity defined by wall 41, outer walls 42, 43 and top wall 44 define the hull or pontoon receiving cavity. The lower edge 45LE of wall 43 is thickened by folding, and although the lower edge 43L of wall 43 can be shaped to form a groove, in this embodiment a separate shaped fiberglass strip 44S is formed with or glued onto lower edge 43L of side 43 to form groove 44'. In this case, the inner bracing provided by concave wall 41 is eliminated and the foam filling may also be eliminated.

Figure 5A:
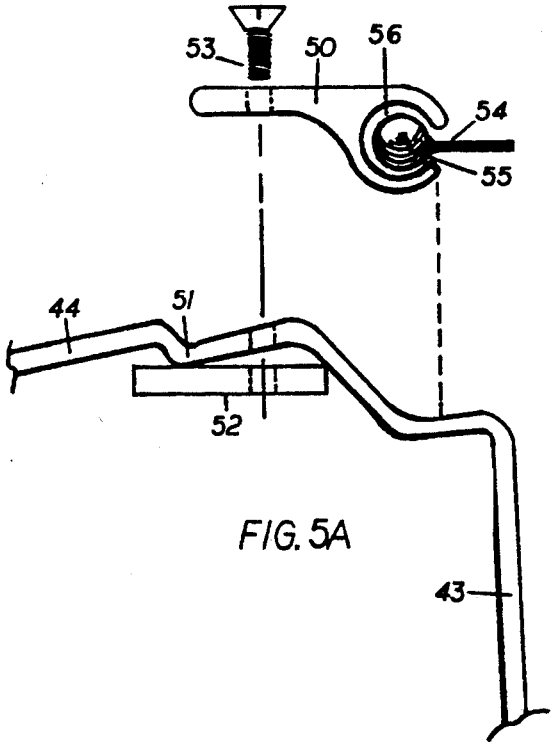
FIG. 5*a* is an exploded view showing the trampoline track profile and trampoline track back-up.
Figure 5B:
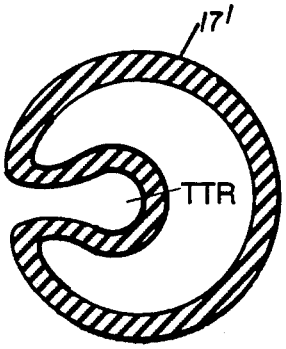
FIG. 5*b* is a sectional view of a modification of the fore and aft cross-bar members.

An inner upper edge of the molded deck sub-frame members 15 and 16 is shown in FIG. 5a. In this view, what becomes the inner corner edge is provided with a built-in trampoline track guide 50 which is secured into place in the complementary profile corner 51 and which has a metal trampoline back-up plate 52 which is secured by flat-headed, flush fitting fasteners 53. The platform or trampoline 54 has a rigid beaded edge 55 which slides in track 56 of the trampoline track guide 50. The fore and aft ends of the trampoline may be laced to the fore and aft cross-bars, if desired, or have fore and aft wrap-around edges or sleeves. In a preferred embodiment, the fore and aft cross bar members can be extruded as shown in FIG. 5b to include a tramp track race TTR to tighten the trampoline, the cross members fit onto the pins 17P and pulled so that it rolls into the saddle 17.

Figure 8A:
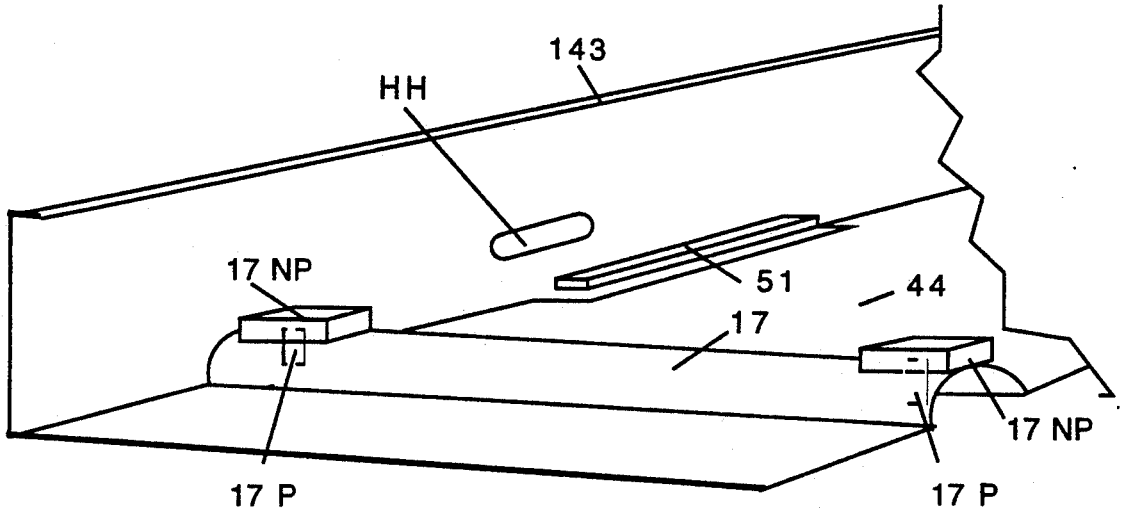
FIGS. 8*a* is an enlarged view illustrating the tubular cross-bar receiving saddle sockets and their sub-assemblies.
Figure 8B:
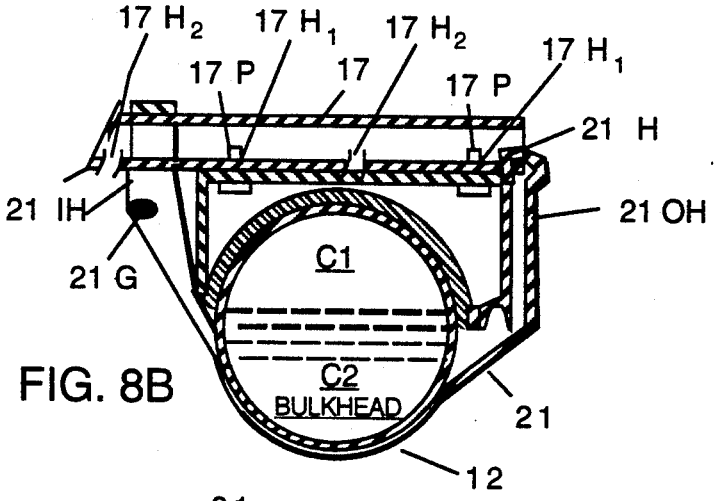
FIG. 8*b* illustrates the fitting in the socket of the cross-bar assembly with the guide and retaining pins and the use of a stretchable retaining strap for making the retention self-adjusting when, for example, the pontoons loose air.

As shown in FIG. 8a, the guide pins 17P are secured by molded nut plates 17NP at the bottom of saddle or concavitites 17 and 18. The metal back-up plate 51 is bedded-in metal putty and faired into the laminate in the usual way. Similarly, the nut plates 17NP in each saddle or socket corner are mounted flush to the vertical deck surface and centered on the saddle bed in metal putty and faired into saddle 17.

Figure 6C:
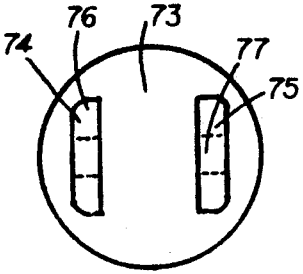
FIGS. 6*a*, 6*b* and 6*c* are top, side and end views, respectively, of the shroud, mast, and tiller arm yoke clevis.
Figure 6B:
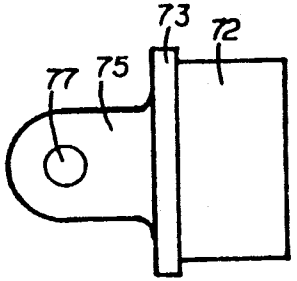
Figure 6A:
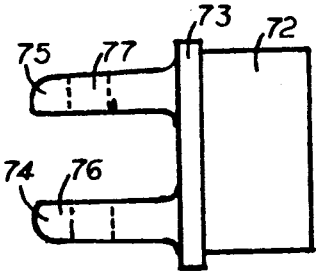
Figure 7A:
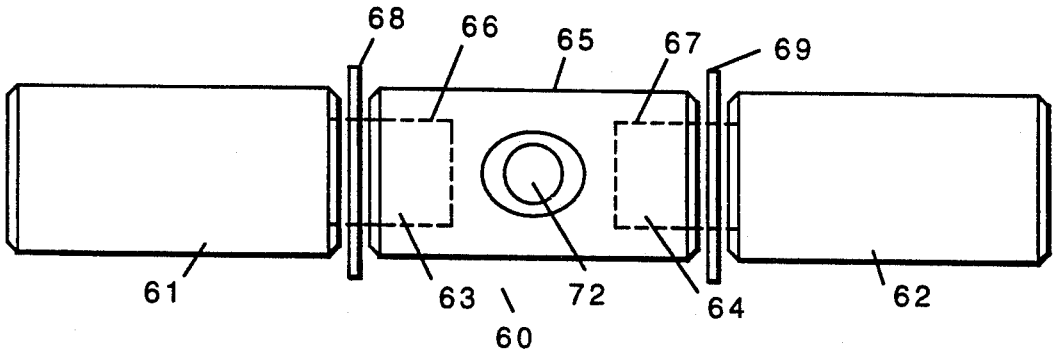
FIG. 7*a* shows the side-stay fitting assembly.
Figure 7B:
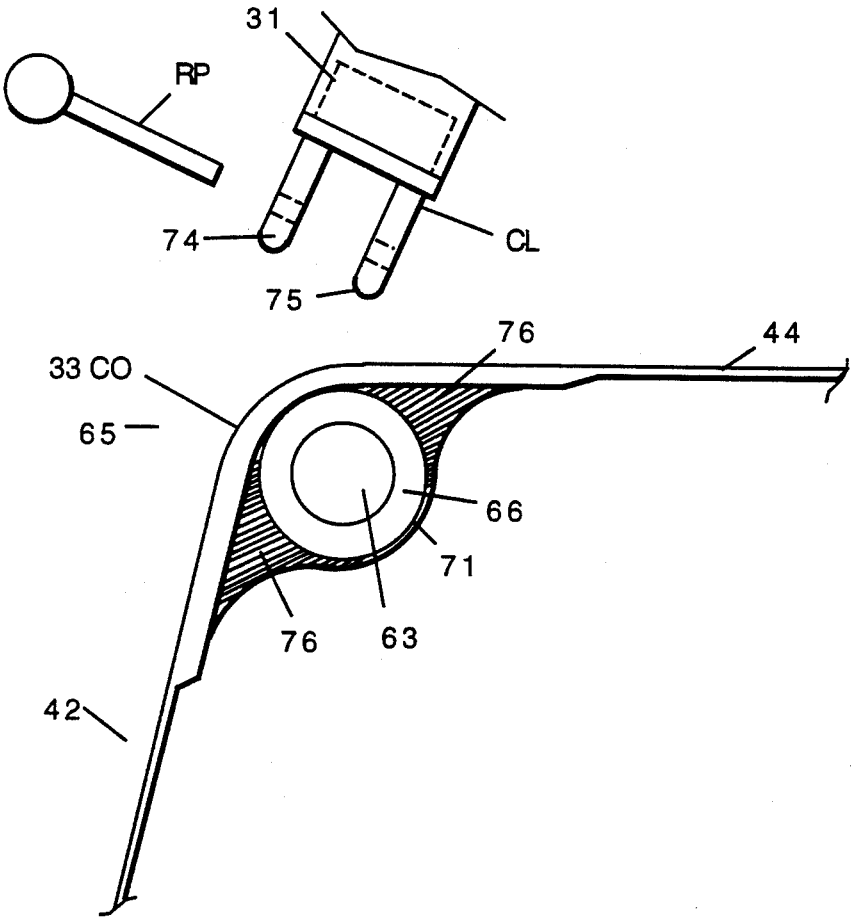
FIG. 7*b* shows its installation in the molded side frame members and a shroud yoke and ringed fastener pin.

The upper and lower ends of each shroud tube 30 and 31 are each provided with a clevis (see FIGS. 6a, 6b and 6c) the lower ones of which are fitted upon a side-stay fitting assembly built into the molded sub-frame members 15 and 16 as shown in FIGS. 7a and 7b. There are a pair of sidestay fitting assemblies SS1 and SS2 on each longitudinal sub-frame or deck assembly, the spacing SS between assemblies being such that the longitudinal sub-frame assemblies are interchangeable side-to-side. As shown in FIG. 7a, each sidestay fitting assembly 60 includes a pair of pivot pins 63 and 64, respectively, which rotatably support sidestay base sleeve 65 on sockets 66, 67 and a pair of thrust washers 68, 69 are positioned between the ends of sidestay base sleeve 65 and the fiberglass deck plates. Each sidestay fitting assembly shown in FIG. 7a is proportionally (each is about ⅓ of the way from the ends, respectively) mounted in the upper outside corners of the molded longitudinal sub-frame assemblies on the opposite side from the trampoline slide guides so that the sub-frame assemblies are interchangeable. As illustrated in FIG. 7b, an epoxy 70 is used to fix the pins 63 and 67 in place so that side-stay base sleeve 65 is exposed in opening 33CO and rotatable about its axis. A fiberglass laminate 71 is applied over this assembly to form a closed chamber in the molded longitudinal sub-frame members (see FIG. 7b). The side-stay base sleeve 65 is provided with a thru aperture 72A through which a retaining pin RP is passed to secure the end clevis CL (shown in detail in FIGS. 6a, 6b, 6c) of the shroud tubes 30, 31. The base sleeves 65 rotate on pivot pins 63, 67 so as to provide easy adjustment and accommodation of the clevis ends at the lower ends of the rigid shroud tubes 30 and 31. Shroud tubes 30 and 31 are two parts each, thereby making four shroud tube sections and three mast tube sections of the same length. This makes stocking and production costs less. Only the fixtures differ on each piece.

Hand holds HH may be formed in sidewalls 42, 43 (or also in top wall 44) so that the boat can be lifted and carried easily. They may also be separate discrete handles secured or otherwise fastened to the sidewalls.

Figure 6D:
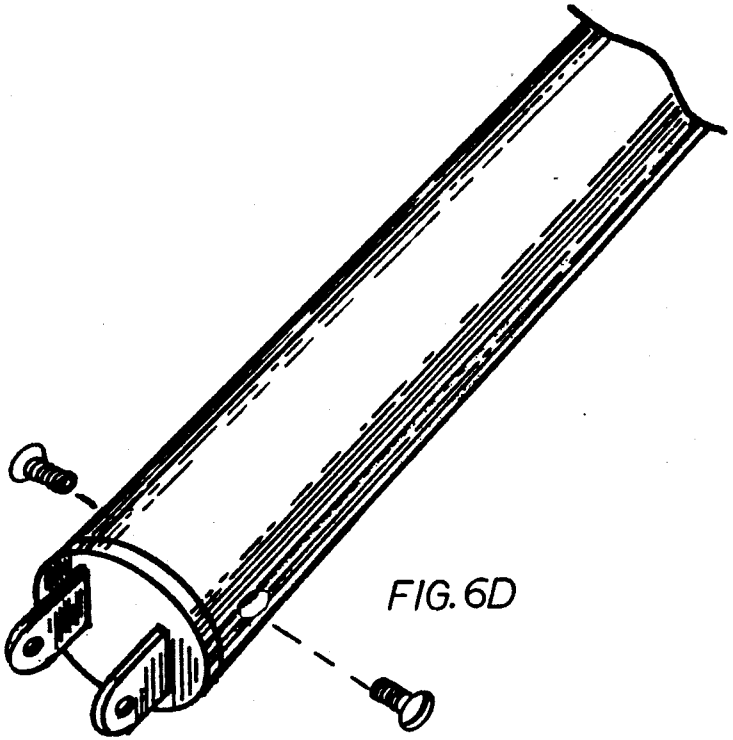
FIG. 6*d* and FIG. 6*e* show the of yoke FIG. 6*a*, 6*b* and 6*c* used in the lower mast and shroud (both ends) assemblies.
Figure 6E:
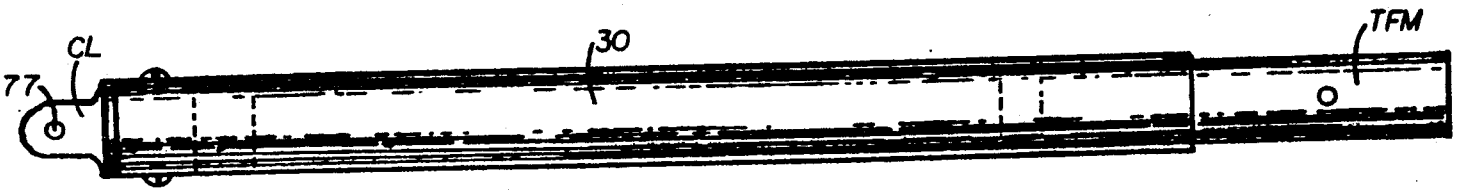

Referring to FIGS. 6a, 6b and 6c, the shroud clevises or yoke are cast aluminum magnesium (all the metal components herein are preferably lightweight aluminum magnesium) which has been cast in the form illustrated in FIGS. 6a, 6b and 6c. A base member 72 has a diameter such that it may be fitted or telescoped within the base of tubes 30, 31 and a closure member 73 having integral legs or clevis legs or yoke members 74, 75 formed therewith and spaced apart to encompass side-stay base sleeve 65. Aligned holes 76, 77 and the legs 74, 75 of the yoke receive a ringed pin passing through pivot holes 72A so that when the mast is raised by pulling one of the shrouds in a direction to rotate the mast about its pivot (to be described more fully hereafter), the shroud clevis is fitted on the base sleeve 72 and a pin passed therethrough to easily step the mast. The opposite shroud is mounted on its side-stay base sleeve in the same way. The mast shroud tube upper end assembly is shown in FIG. 6c is provided with a shroud yoke (or a hole, if desired). As shown in FIGS. 6e, and 6d and the shroud and mast tubes are multiple parts and have ends internal, telescoping fitment TFM members to allow them to be dismantled in the manner shown in my above-identified patent and are likewise filled with foam F for flotation purposes.

Figure 9A:
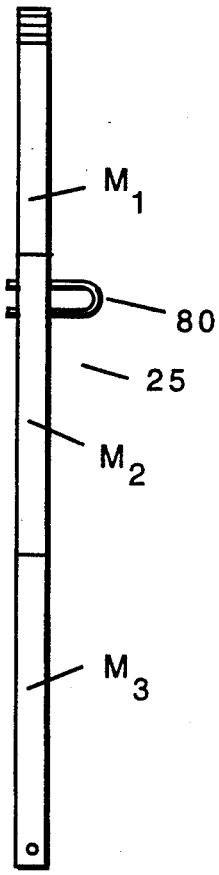
FIG. 9*a* is a side elevational view of a complete mast assembly.

The mast 25 is shown in FIG. 9a and is made-up of three separate foam-filled tube assemblies $M_1$, $M_2$, $M_3$ and has a lower clevis element which is identical to that shown in FIG. 6a, 6b and 6c and its coupling to the stepping arrangement will be described more fully hereafter. However, it should be noted that in FIG. 9a, the mast has a bow-eye assembly 80 and the upper ends of each shroud 30 and 31 has a bar 81 passing through the upper shroud yokes $CL_1$ and $CL_2$ and secured by a pin and through the bow-eye 80 so as to provide a pivotal connection for each shroud to a point about a third (⅓) of the way down from the upper end of the mast. This enables the user to elevate and step the mast using either shroud 30 or 31. The shroud secured in this way and secured at their lower ends to the molded end side-stay base sleeves provides a rigid three-point support for the mast thereby providing a high degree of mast stability and safety. The mast itself is foam-filled in the manner disclosed in my above-identified patent and International application.

Figure 10A:
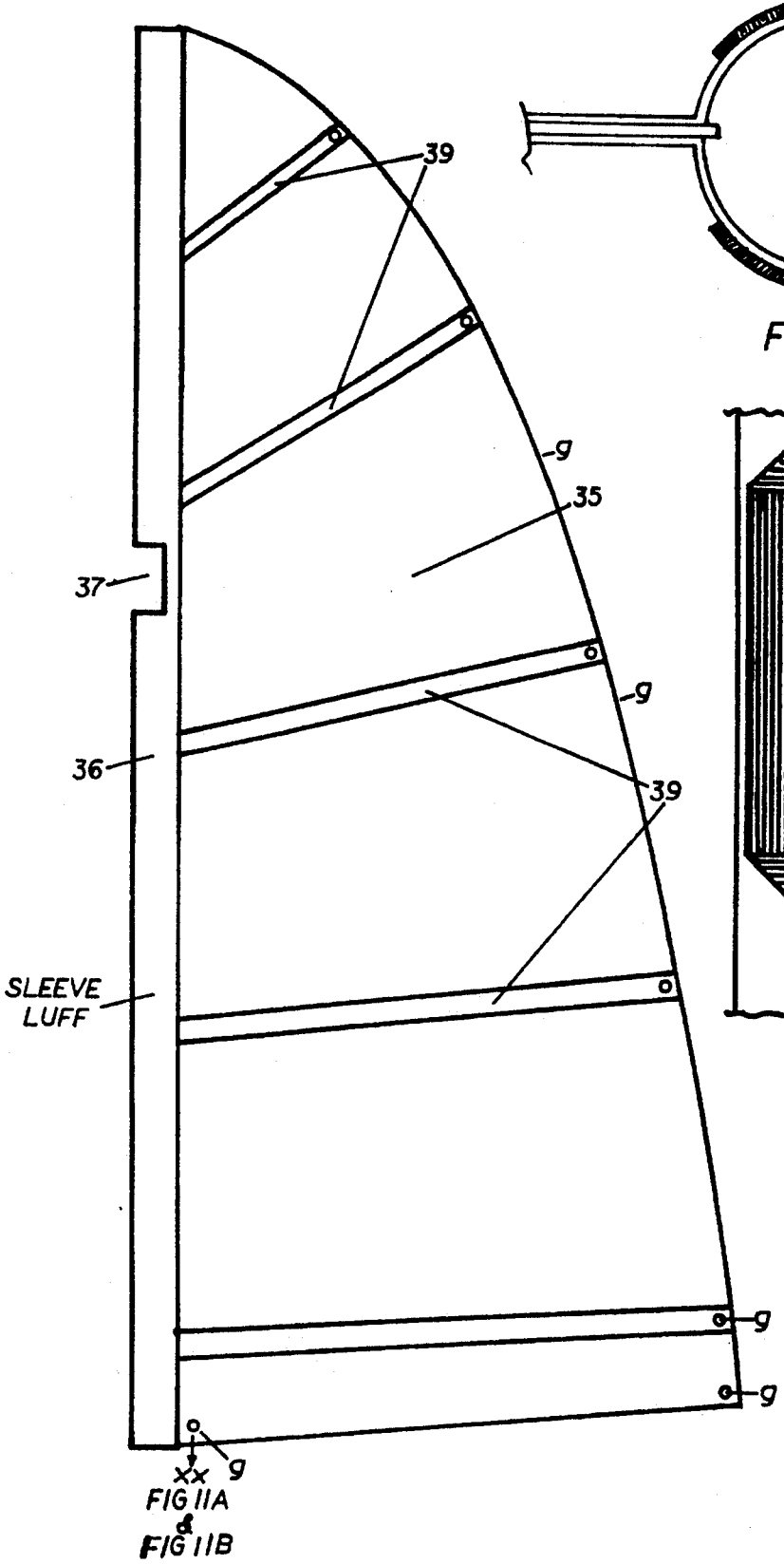
FIG. 10*a* is an elevational view of the sail assembly.
Figure 10C:
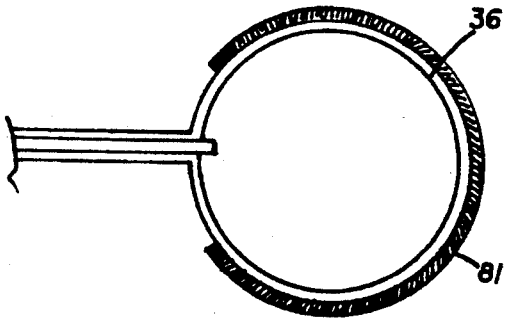
FIG. 10*c* shows a sectional view through the sail sleeve.
Figure 10B:
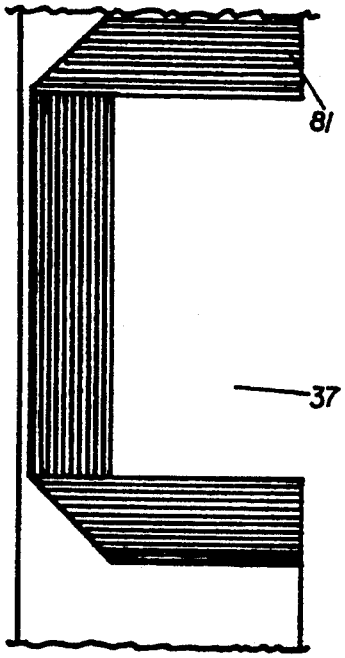
FIG. 10*b* is an enlarged view illustrating the web reinforcement of the sail around the cut-out for the shroud connection.

As shown in FIG. 10a, the sail 35 is provided with battens 39 and a sleeve 36 having a cut-out 37 through which the bow-eye 80 passes. The trailing edge of each batten 39 is provided with a rolled rim grommet G, preferably of nickel so as to maintain the battens in place. The battens may be sewn in place through use of a pocket at the end of the batten. In one embodiment of the invention, a sail having a foot of 7 feet 4 inches, a leach edge of about 16 feet, and a luff edge of about 16 feet has proved satisfactory. A pair of steel rings is provided in the lower edges of the sail along the foot for the main sheet. As shown in FIG. 10*b* and 10*c*, the area around cut-out 37 in the sail sleeve is provided with web reinforcements 81.

Referring now to the rudder and daggerboard arrangements (FIGS. 11*a, b* and *c* and FIGS. 12*a* and 12*b*), the rudder and daggerboard are identical and made of a molded fiberglass but it will be appreciated that they may be made of wood or lightweight aluminum or aluminum magnesium alloys. They are comprised of a straight leading edge 85 which has an upper end 86 which is of substantially uniform thickness and a lower end 87 which tapers downwardly to a bottom edge 88. The section 87 has an edge 89 which is designed to pass through the water in hydrodynamically smooth fashion and a trailing edge 90 which is tapered to a relatively thin edge (of about 1/10 inch thick). The dimensions shown in FIGS. 6*a* and 6*b* are merely exemplary.

A mounting hole 86H is provided in the upper rectangular planar section 85, 86 for mounting in the fixture or bracket 24 or 27, depending on whether it is being used as a rudder or as a center board. It is obvious that the rudder can also perform the center board function even though it serves as a rudder if turned around the other way.

Figure 11A:
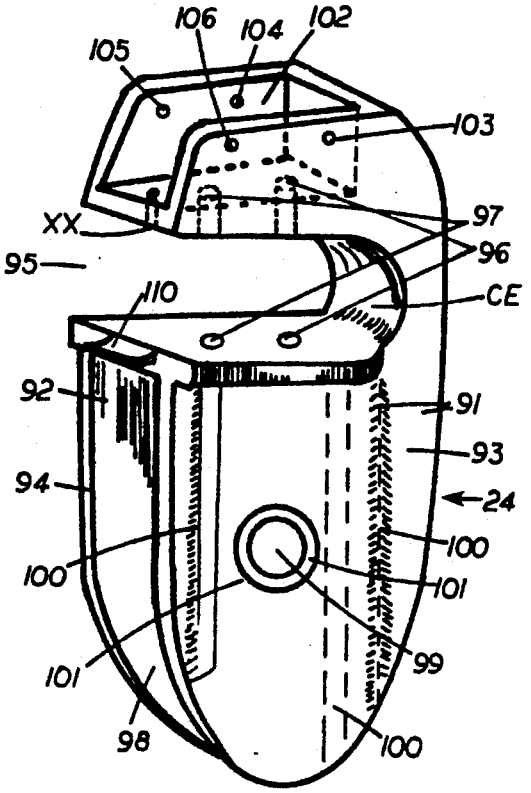
FIG. 11*a* is a perspective view of the daggerboard-rudder casting.
Figure 12B:
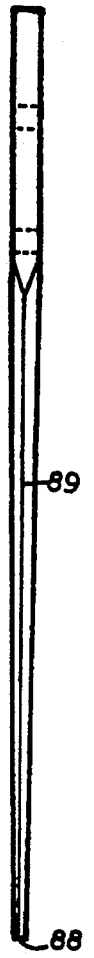
FIG. 12*b* is a front view of the rudder/-daggerboard.
Figure 12A:
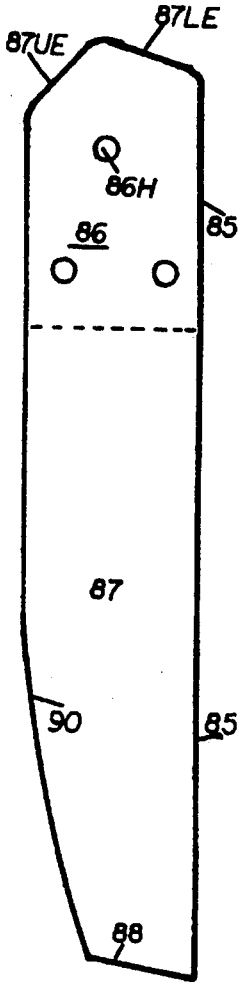
FIG. 12*a* is a side elevational view of the rudder-daggerboard.

Referring now to FIG. 11*a*, the center board/rudder mounting bracket is preferably a single casting of aluminum magnesium alloy for strength, light-weight and corrosion resistance. It could also be made of fiberglass composite materials. It includes a pair of vertical side surfaces 91, 92 and side plates 93, 94. A horizontal slot 95 extends from vertical side 92 towards vertical side 91 and the slot has a width which is substantially equal to the outside dimension of fore and aft cross-bars 19 and 20. Additional gussets or flying buttresses 100 may be added for strength. Pairs of spaced securement pin holes 96 and 97 receive a securement pin SP (see FIGS. 11*b* and 11*c*) which has a detent ball when on the fore and aft cross-bars 19 and 20, respectively. A vertically extending slot 98 is formed between legs 93, 94 of the mounting bracket 24 and receive the upper end 86 (FIGS. 12*a* and 12*b*) of the daggerboard or rudder. A pair of aligned transverse holes 99 align with pivot hole 86H and received ring pin RP or a bolt. The upper edge 87UE of the center board or rudder is chamfered or curved so as to permit pivoting movement of the rudder or daggerboard in one direction and the other edge 87LE blocks movement by engaging the upper surface 98S of slot 98.

Figure 11B:
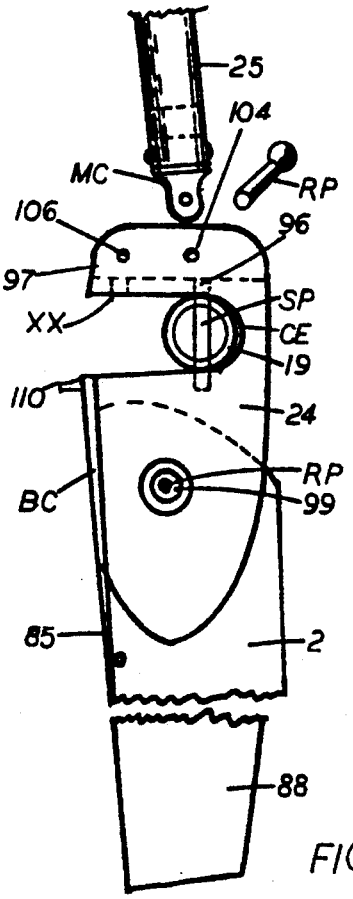
FIG. 11*b* is a side elevational view showing its use on the fore cross-bar in mounting the mast and centerboard.

A hook 110 provides a place for hooking or securing a spring or an elastomeric member such as a bungi cord BC between the center board or rudder so that when an obstruction is hit, the daggerboard or rudder will pivot about its pivotal axis (the chamfered or tapered edge 87UE permits this) and the spring or bungi cord returns it to its normal position. As shown in FIG. 11*b*, position XX allows a shock cord SC to be secured to the grommet hole G on the bottom of front edge of the sail to be pulled down and fixed at location XX to provide a downward force on the sail.

The side surfaces 93, 94 are provided with reinforcing ribs 100 and the pivotal axis is strengthened by means of a raised embossment 101.

A cut-out or recess 102 is provided in the upper edge 90 to receive either the tiller handle 105 (FIG. 11*c*) or to step the mast 25 (FIG. 11*b*). As shown in FIG. 11*b*, when the mounting bracket is utilized to step the mast, the mast clevis MC is secured by passing a detented ring pin RP through aligned holes 103, 104 and a pin passing through aligned holes 96 maintains the fore cross-bar sub-frame member in snug abutment in the complementary curved end CE of slot 95. When the mast has been stepped or raised, the lower end of the mast clevis prevents the pin in holes 96 from becoming dislodged.

Figure 11C:
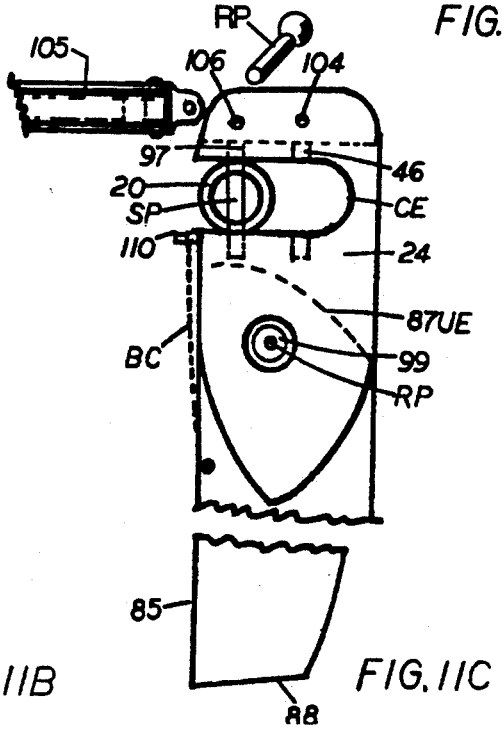
FIG. 11*c* is a side elevational view showing its use on the aft cross-bar in mounting the tiller arm and rudder.

As shown in FIG. 11*c*, the mounting bracket 24 is utilized as a tiller and rudder assembly. In this case, the rearward holes 97 have a pin passed therethrough and the space between the aft cross-bar assembly 20 and the back end of slot 95 is sufficient to allow a very large turning movement of the rudder about the rotary axis defined by the pin passing through apertures 97. At the same time, the tiller arm 105 is secured by a detent pin passing through aligned holes 105 and 106. This also captures the yoke on the bottom of the bottom sail pulley thereby attaching the block to the unit and at the same time, holds the casting mounting pin in place.

It will be noted that the molded side frame assemblies or deck plates may be interchanged, that the fore and aft cross-bar sub-assemblies may be interchanged, that the clevis on the ends of the mast and shrouds and tiller may be interchanged, that the rigid shroud may be interchanged and that the hulls may be interchanged and, the center board, rudder, daggerboard mount and rudder mounts may be interchanged. This provides a great degree of simplicity and avoidance of problems in assembling and disassembling the boat for use.

The support platform or 54 has lateral side ribs 55 which are received in the guides 56 and at the fore and aft positions may be laced to the fore and aft cross-bars or may have a wrap around sleeve which are assembled to the fore and aft cross pieces prior to assembly to the molded longitudinal members. As noted earlier, in a preferred embodiment, the fore and aft cross bars are extruded sections (FIG. 5*b*) with a slot TTR serving as a guide for fore and aft ribs (not shown) on the trampoline. The molded sub-frame members may have covered stowage compartments SC formed in the top surfaces 44 to stow small articles, and beverage containers, which, because of the foam filling, will keep them cold.

The assembled frame and pontoon hulls with a central seating supported between fore and aft tubular cross bars can be used as a canoe-type or paddle pleasure boat or a small motor (electric or gasoline) can be secured to one of the cross bars for propulsion. A bicycle-type seating mount with pedal and crank drivingly coupled to a propeller can be used for propulsion purposes. Additional passengers may sit on the upper surface of the molded longitudinal frame members. Different lengths of fore and aft cross frame members can be provided to allow the user greater use flexibility for the boat. For example, instead of eight foot width fore and aft cross bars, ten foot or longer cross bars may be provided to make a large raft, or four foot ones to make a narrow canoe (in addition to or in place of a standard size cross bar). Different positions for the holes 17H2 to receive pins 17P allows the user great flexibility in uses to which the assembled frame and pontoon hulls may be put. Projecting ends of the fore and aft cross bars need not be symmetrical.

Inflatable bolsters with or without handles may be provided for back rests, fenders, or rollers to get the assembled boat to and from the water, and as extra flotation in case of emergency.

As many different embodiments of the invention will be obvious to those skilled in the art, some of which have been disclosed or referred to herein, it is to be understood that the specific embodiments of the invention as presented herein are intended to be by way of illustration only and are not limiting on the invention and it is understood that such embodiments, changes or modifications may be made without departing from the spirit and scope of the invention as set forth in the claims appended hereto.

What is claimed is:

1. In a catamaran having a collapsible frame and a pair of elongated pontoons spacedly secured to said collapsible frame, said frame includes fore and aft cross bar sub-frame members and a pair of longitudinally extending sub-frame members and a support platform supported on said frame, the improvement comprising each said longitudinally extending sub-frame member being molded and including:

a pontoon embracing longitudinal cavity which is the length of said longitudinally extending sub-frame member, and a pair of parallel longitudinal edges, one longitudinal edge at each side of said longitudinal cavity, respectively, a first of said longitudinal edges having a slot therein and the other of said longitudinal edges having a shape complementary to said longitudinal slot, whereby said pairs of longitudinal edges of said pair of molded sub-frame members, respectively, can interfit and said concavities face each other to form a storage space for said pontoons and said fore and aft tubular sub-frame member when not in use.

2. The catamaran defined in claim 1 wherein said pontoon embracing cavity includes an arcuate concave wall extending between said pair of longitudinal edges.

3. In a catamaran as defined in claim 1, including a center board and rudder mounting frame for securement to said fore and aft cross-bar sub-frame members, each said fore and aft sub-frame member having an outside dimension D, comprising:

a unitary member having a top surface, a bottom surface, a pair of vertical side surfaces, a horizontal slot extending from one said vertical side toward the other said vertical side, said slot having a width which is substantially equal to said outside dimension D, a pair of spaced securement means formed in said slot for securing one said fore and aft cross-bar sub-frame members in said horizontal slot at fore and aft ends of said slot, respectively, a vertically extending slot extending from said bottom surface and for receiving one of said center board and rudder, a pivot pin, and means defining a transverse bore hole for receiving said pivot pin for the one of said center board and rudder received in said vertically extending slot.

4. The mounting frame defined in claim 3 wherein said catamaran is a sailboat having a mast having an end and sail thereon and a tiller arm, said mounting frame including a top slot extending from said top surface toward said horizontal slot, and a clevis member adapted for securement to the end of said mast and means for securing said clevis member in said top slot.

5. The mounting member defined in claim 4 including a center board and means for pivotally mounting said center board and rudder in said vertical slot and resilient means for biasing one of said center board and rudder in a direction opposite the direction of travel of said boat so that when said one of said daggerboard and rudder engages a fixed obstruction, said one of said center board and rudder will pivot about said pivot pin and over said obstruction.

6. The mounting bracket defined in claim 3 wherein said aft position of said horizontal slot is bounded by a wall such that when said cross-bar sub-frame member having an outside dimension D is in said slot it can engage said end wall.

7. The catamaran defined in claim 1 including a sail, mast and one or more rigid shroud tubes for maintaining said mast at selected angular positions, said one or more rigid shroud tubes having upper and lower ends, means pivotally securing the upper end of said one or more shroud tubes to said mast, and shroud mounting means in said molded sub-frame members for securing said lower end of said one or more rigid shroud tubes to said one of said molded sub-frame members.

8. The catamaran defined in claim 7 including yoke means mounted in the lower end of said one or more shroud tubes, said shroud mounting means including an apertured bar member, means mounting said apertured bar member in said molded sub-frame members for rotation about its axis, said apertured bar member having a through aperture transverse to said axis and retaining pin means passing through said yoke means and through aperture.

9. The catamaran defined in claim 8 wherein said means mounting said apertured bar includes bearing pins for supporting said apertured bar member for rotation.

10. The catamaran defined in claim 1 wherein each said longitudinally extending sub-frame member has an upper surface and fore and aft sockets molded in said upper surface for receiving said fore and aft cross bar sub-frame member, and means for retaining said cross bar sub-frame members in said sockets.

11. The catamaran defined in claim 10 wherein said means for retaining includes pin means projecting between said sockets and said cross bar sub-frame members, and strap means embracing said pontoons and secured to said cross bar sub-frame members.

12. The catamaran defined in claim 1 wherein said support platform is a trampoline having a pair of rigid rib means at the lateral sides thereof, said sub-frame members including a guide track for receiving one of said pair of rigid rib means, respectively.

13. The catamaran defined in claim 12 wherein said fore and aft cross bar sub-frame members have a guide track therein and said trampoline has fore and aft edges having further rib means therein adapted to be received in said guide tracks in said fore and aft cross bar sub-frame members, respectively.

14. The catamaran defined in claim 13 wherein both of said longitudinally extending sub-frame members has a deck surface having lateral edges and said guide track is secured to one of said lateral edges, respectively, and said shroud mounting means is mounted in the other of said lateral edges, respectively.

15. The catamaran defined in claim 7, said fore cross bar sub-frame member having a diameter D, including a center board mounting bracket, said bracket having a horizontal slot of width substantially equal to D for receiving said fore cross bar sub-frame member snugly at the end of said horizontal slot, a center board, a vertical slot in said mounting bracket for receiving said center board, and means pivotally mounting said center board in said vertical slot, and means pivotally mounting said mast on said center board mounting bracket.

16. The catamaran defined in claim 7, said aft cross bar sub-frame member having a diameter D, and including a rudder and a rudder mounting bracket, said rudder mounting bracket having a horizontal slot of width substantially equal to D and means pivotally securing said rudder mounting bracket in said horizontal slot on said aft cross bar so that said rudder mounting bracket can be pivoted through a predetermined number of degrees thereon, and means for pivotally mounting said rudder on said rudder mounting bracket, a tiller handle, and means for pivotally mounting said tiller handle on said rudder mounting bracket.

17. In a collapsible rectangular frame for a catamaran having a pair of hulls, and a trampoline, the improvement comprising:

said frame being collapsible and including fore and aft cross-bar sub-frames and a pair of longitudinally extending molded members extending between said fore cross-bar and aft cross-bar sub-frames, each said longitudinally extending molded member having upper and lower sides including hull encompassing semi-circular cavity on said lower side, flexible and stretchable strap means for securing said hulls in said semi-circular cavities, respectively, fore and aft cross-bar sockets molded in said top surface, and at least one locating and retaining pin extending between each socket and the ends of each tubular cross-bar, respectively, said flexible strap means retaining each said tubular cross-bar on said locating and retaining pin, respectively.

18. The collapsible rectangular frame for a catamaran as defined in claim 17, said flexible strap means including elastic means for retaining said hulls in said semi-circular cavities.

19. In a catamaran sailboat having a collapsible frame and a pair of elongated pontoons spacedly secured to said collapsible frame, said frame includes fore and aft cross bar sub-frame members having lateral ends and a pair of longitudinally extending sub-frame members having fore and aft ends, a mast, a center board and tiller rudder assembly, the improvement comprising each said longitudinally extending sub-frame member being molded and including:

a pontoon embracing longitudinal cavity which is the length of said longitudinally extending sub-frame member, and fore and aft sockets in the fore and aft ends for receiving the lateral ends of said fore and aft cross bar sub-frame members.

20. The catamaran defined in claim 19 wherein said pontoon embracing cavity is defined by an inner arcuate wall surface.

21. The catamaran sailboat defined in claim 19 said catamaran having fore and aft cross bar sub-frame members, each having an outside dimension D, and a mounting frame for each said centerboard and tiller rudder, respectively, each said mounting frame comprising:

a unitary member having a top surface, a bottom surface, a pair of vertical side surfaces, a horizontal slot extending from one said vertical side toward the other said vertical side, said slot having a width which is substantially equal to said outside dimension D, and fore and aft ends, a pair of spaced securement means formed in said slot for securing to said fore and aft cross bar sub-frame members in said horizontal slot at fore and aft ends of said slot, respectively, a vertically extending slot extending from said bottom surface for receiving one of said center board and rudder, a pivot in, and a transverse hole for receiving said pivot pin for the one of said center board and rudder received in said vertically extending slots, respectively.

22. The catamaran defined in claim 21 including a top slot extending from said top surface toward said horizontal slot, and a clevis member adapted for securement to the end of said mast and end of a tiller, respectively, and means for securing said clevis member in said top slot, respectively.

23. The catamaran frame defined in claim 21 including means for pivotally mounting said center board and rudder, respectively, in said vertical slot and resilient means for biasing said said center board and rudder, respectively, in a direction opposite the direction of travel of said boat so that when said center board or rudder engages a fixed obstruction, said one of said center board and rudder will pivot about said pivot pin and over said obstruction.

24. The catamaran defined in claim 21 wherein said horizontal slot has an aft position and said aft position of said horizontal slot is bounded by a wall such that when said cross bar sub-frame member having an outside dimension D is in said slot it can engage said end wall.

25. In a rectangular frame for a catamaran having a pair of hulls, and a trampoline, the improvement comprising:

said frame being collapsible and including fore and aft cross bar tubes having lateral ends and a pair of longitudinally extending molded members extending between said fore cross bar and aft cross bar tubes, each said longitudinally extending molded member having upper and lower sides including hull encompassing longitudinal cavity on said lower side, means for securing said hulls in said longitudinal cavities, respectively, fore and aft cross bar saddles molded in said top surface, and at least one locating and retaining pin in each, the ends of each tubular cross bar having a locating aperture for receiving said locating and retaining pins.

26. The catamaran defined in claim 25 wherein said means for securing said hulls have a pair of ends and are flexible and stretchable and are secured at each end, respectively to the lateral ends of said fore and aft tubes, respectively.

27. The catamaran having a collapsible frame and a pair of elongated inflatable pontoons spacedly secured to said collapsible frame, said frame includes fore and aft cross bar sub-frame members having lateral ends and a pair of longitudinally extending sub-frame members having fore and aft ends, the improvement comprising each said longitudinally extending sub-frame member being molded and having an upper surface and depending side surfaces, including:

fore and aft saddles molded in each said upper surface for receiving the lateral ends of said fore and aft cross bar sub-frame members, a pontoon embracing longitudinal cavity which extends for the length of said longitudinally extending sub-frame member and supporting means supported between said fore and aft cross bar sub-frame members.

28. A mounting frame for the center board and rudder of a catamaran having fore and aft cross bar sub-frame members, each cross bar sub-frame member having an outside dimension D, and comprising:

a unitary member having a top surface, a bottom surface, a pair of vertical side surfaces, a horizontal slot extending from one said vertical side toward the other said vertical side, said slot having fore and aft ends and width which is substantially equal to said outside dimension D of said fore and aft cross bar sub-frame members, a pair of spaced securement means formed in said slot for selectively securing to one of said fore and aft cross bar sub-frame members in said horizontal slot at one of said fore and aft ends of said slot, respectively, a vertically extending slot extending from said bottom surface for receiving one of said center board and rudder, a pivot pin, and means defining a transverse bore hole between said pair of vertical side surfaces for receiving said pivot pin for the one of said center board and rudder received in said vertically extending slot.

29. The center board and rudder mounting frame defined in claim 28 including a top slot extending from said top surface toward said horizontal slot, and a clevis member adapted for securement to the end of a mast and means for securing said clevis member in said top slot.

30. The center board and rudder mounting frame defined in claim 28 including means for pivotally mounting said center board in said vertical slot and resilient means for biasing said one of said center board in a direction opposite the direction of travel of said boat so that when said said center board engages a fixed obstruction, said said center board will pivot about said pivot and over said obstruction.

31. The catamaran defined in claim 30 including support means extending between said fore and aft cross bar tubes.

32. In a catamaran having a rectangular frame, a pair of inflatable hulls, the improvement comprising:

said frame being collapsible and including fore and aft cross bar tubes having lateral ends, a pair of longitudinally extending molded members extending between said fore and aft cross bar tubes, each said longitudinally extending molded member having a top surface and depending sides constituting an arcuate hull encompassing cavity below said top surface in each of said molded members, means for securing said hulls in said cavities when inflated, respectively, including fore and aft cross bar saddles molded in both said top surface, and at least one locating and retaining pin in each fore and aft cross bar saddle, each cross bar tube having a pair of lateral ends and locating apertures for receiving said locating and retaining pins in each lateral end, respectively.

33. The catamaran defined in claim 32 wherein said fore and aft cross bar tubes have a predetermined length and there are a plurality of said locating apertures in at least one lateral end of a cross bar tube so that the beam width of said catamaran can be adjusted.

34. The catamaran defined in claim 33 wherein said support means is narrow enough and said predetermined length is great enough that a person supported on said support means can operate a paddle between said support means and said inflatable hulls.

* * * * *